US005546066A

United States Patent [19]

Kondo et al.

[11] Patent Number: 5,546,066

[45] Date of Patent: Aug. 13, 1996

[54] DELAYED-FUSION FUSE

[75] Inventors: Hiroki Kondo; Mitsuhiko Totsuka; Toshiharu Kudo; Hisashi Hanazaki, all of Shizuoka, Japan

[73] Assignee: Yazaki Corporation, Tokyo, Japan

[21] Appl. No.: 296,582

[22] Filed: Aug. 25, 1994

[30] Foreign Application Priority Data

Aug. 27, 1993 [JP] Japan ..... 5-234291

[51] Int. Cl.[6] ..... H01H 85/04; H01H 71/20; H01H 69/02

[52] U.S. Cl. ..... 337/163; 337/166; 337/152; 337/160; 29/623

[58] Field of Search ..... 337/152, 160, 337/166, 163; 29/623

[56] References Cited

U.S. PATENT DOCUMENTS

| | | | |
|---|---|---|---|
| 2,711,464 | 6/1955 | Anderson . | |
| 4,464,052 | 2/1987 | Matsunaga | 337/166 |
| 4,862,134 | 8/1989 | Poerschke | 337/231 |
| 4,944,084 | 7/1990 | Horibe et al. | 29/623 |
| 5,097,247 | 3/1992 | Doerrwaechter | 337/405 |
| 5,159,309 | 10/1992 | Bayer | 337/402 |
| 5,262,751 | 11/1993 | Kudo et al. | 337/296 |
| 5,309,625 | 3/1994 | Onishi | 29/623 |

FOREIGN PATENT DOCUMENTS

| | | | |
|---|---|---|---|
| 59-66844 | 5/1984 | Japan | H01H 85/08 |
| 1315924 | 12/1989 | Japan | H01H 85/06 |
| 0817797 | 5/1979 | U.S.S.R. | 337/160 |

*Primary Examiner*—Leo P. Picard
*Assistant Examiner*—Stephen T. Ryan
*Attorney, Agent, or Firm*—Sughrue, Mion, Zinn, Macpeak & Seas

[57] ABSTRACT

The present invention provides a delayed-fusion fuse by which its predetermined durability can be reliably ensured, and its stable pre-arcing time-current characteristics can be obtained, even when a current exceeding the steady-state current such as a motor lock current frequently flows in the fuse. The delayed-fusion fuse includes a pair of electric connecting sections formed on both sides of a fusible section having a narrow fusing portion made of an electrically conductive metal. Also, the delayed-fusion fuse includes a metallic chip made of low fusing point metal for absorbing heat generated in the fusible section, and a covering and adhering section for holding the metallic chip on the fusible section. A thin metallic layer forms a solid solution with the low fusing point metal, where the solid solution requires an energy of formation which is higher than that of the formation of a solid solution made of the electrically conductive metal and the low fusing point metal. This thin metallic layer is interposed between a surface of the covering and adhering section and a surface of the low fusing point metallic chip. Specifically, the thin metallic layer is provided on a surface of the fusible section in the form of a plating layer.

5 Claims, 7 Drawing Sheets

DELAYED-FUSION FUSE

BACKGROUND OF THE INVENTION

1. Field of the Invention

The present invention relates to a fuse used for protecting the electric circuit of an automobile and others, and more particularly relates to a delayed-fusion fuse, the durability of which is enhanced with respect to a transient current applied to the fuse.

2. Description of the Related Art

In general, the pre-arcing time-current characteristics of a fuse used for protecting the electric circuit of an automobile and others are distinguished between the high current region H and the low current region L, as shown in FIG. 7. The high current region H of the former is a region in which fusion is caused by a burst current in the case of a dead short-circuit, and the fusion advances in a relatively short period of time in which several seconds passes from the heat generation to the fusion. Therefore, the electric circuit is shut off before the covered portion of an electric wire is scorched or the casing is melted.

On the other hand, the low current region L of the latter is a region in which a relatively long period of time is required from the generation of heat to the fusion of a fuse. In this region, when a rare short-circuit is caused, the fusible section is overheated for a long period of time, so that the covered portion of an electric wire scorches and smokes, and further there is a possibility that the casing is melted. For example, a transient current several times as high as the steady-state load current flows in the load circuit of an electric motor when the motor is started. In the case of a power-window motor, a motor lock current several times as high as the steady-state load current flows in the load circuit when the windowpane is fully closed or opened. That is, a current exceeding the steady-state current frequently flows in the low current region. Therefore, in the load circuit of an electric motor, a delayed-fusion fuse is used, which is not fused with respect to a transient current exceeding the steady-state current and also with respect to a motor lock current.

Conventionally, this type delayed-fusion fuse is disclosed, for example, in Japanese Unexamined Utility Model Publication No. 59-66844 and others, by which the pre-arcing time-current characteristics are improved in the following manner. A low fusing point metallic chip is held in an intermediate portion of the fuse body made of fusible metal of high fusing point, and by the diffusion of the low fusing point metallic chip, an alloy is generated. By the generation of the alloy, the pre-arcing time-current characteristics are improved.

As shown in FIG. 8, the delayed-fusion fuse 100 is integrally composed of an electrically conductive metallic plate, and a pair of electrically connecting terminal sections 103 are provided on both sides of a narrow fusible section 101. A fusing section 102 holding a low fusing point metallic chip 110 providing a heat absorbing effect is formed at an intermediate position of this fusible section 101. The delayed-fusion fuse 100 is folded into a reverse U-shape around this fusing section 102.

Because of the action of the low fusing point metallic chip 110, a time lag from the input of a current to the fusion of the fuse can be maintained in the following manner. For example, suppose a low current flowing during the starting of a motor is higher than an allowable continuous current of an electric wire used in the electric circuit. However, further suppose the current is in a range of fusion of the fusible section 101. Even when the fusible section 101 is heated and generated heat concentrates on the fusing section 102, the heat is transmitted to and absorbed by the low fusing point metallic chip 110, the heat conductivity of which is high, and the heat absorption effect of which is excellent. In this way, the time lag can be ensured. In other words, an allowable range of the fusing section 102 which is not instantaneously fused even when a transient current flows in the fuse, is extended by the low fusing point metallic chip 110, so that the property of delayed fusion can be ensured.

In this case, when the property of delayed fusion is excessively provided, the electric wire is put in an overheating condition for a long period of time, and the covered portion of the electric wire scorches and smokes as described before. Therefore, at a point of time exceeding the predetermined time lag, the delayed-fusion fuse 100 must be fused away. With reference to FIG. 9, this principle will be explained below. In accordance with the transmission and absorption of heat generated when a rush current flows, the temperature of the metallic chip 110 is raised (FIG. 9*a*). When the temperature reaches the low fusing point, the low fusing point metallic chip 110 is fused so that the fused metal diffuses into the fusible section 101, and a solid solution, the fusing point of which is lower than that of the original fusible section 101; that is, an alloy layer 111 is formed (FIG. 9*b*). Because of this, the fusible section 101 is fused away after the predetermined time lag has passed (FIG. 9*c*).

However, in the conventional delayed-fusion fuse described above, the low fusing point metallic chip directly comes into contact with the heated fusing section. Therefore, when a transient current flows which is in the low current region and higher than the allowable continuous current (that is, when a current flows which exceeds the steady-state current, for example, when a motor-lock current flows), generated heat in the fusing section is transmitted to the low fusing point metallic chip although the transmitting time is short. When this transient current flows periodically, the low fusing point metallic chip gradually diffuses, and the pre-arcing time-current characteristics are deteriorated, so that the predetermined durability cannot be reliably ensured.

SUMMARY OF THE INVENTION

The present invention has been achieved to solve the above problems. It is an object of the present invention to provide a delayed-fusion fuse by which the predetermined durability can be reliably ensured and the pre-arcing time-current characteristics can be stably obtained even when a current exceeding the steady-state current such as a motor-lock current flows in the fuse frequently.

The above and other objects of the present invention can be accomplished by a delayed-fusion fuse comprising: a fusible section having a narrow fusion portion made of electrically conductive metal; a pair of electric connecting sections provided on both sides of the fusible section; a metallic chip made of low fusing point metal for absorbing heat generated in the fusible section; a covering and adhering section for holding the metallic chip; and a thin metallic layer for increasing the energy of formation of a solid solution between a surface of the covering and adhering section made of the electrically conductive metal, and a surface of the metallic chip, wherein the energy of formation of a solid solution of the thin metallic layer and the low fusing point metal from the metallic chip is higher than the energy of formation of a solid solution between the electrically conductive metal composing the fusible section and the low fusing point metal.

Further, the above object can be accomplished by a delayed-fusion fuse in which the energy of formation of a solid solution of the thin metallic layer and the low fusing point metal from the metallic chip is approximately 7 times as high as the energy of formation of a solid solution between the electrically conductive metal composing the fusible section and the low fusing point metal.

Further, the above object can be accomplished by a delayed-fusion fuse in which the thin metallic layer is a metal-plating layer formed on a surface of the covering and adhering section made of the electrically conductive metal, or a metal-plating layer formed on a surface of the metallic chip made of the low fusing point metal.

Further, the above object can be accomplished by a delayed-fusion fuse in which the metal-plating layer is a nickel-plating layer and the thickness of the nickel-plating layer is 1 to 10 mm.

In the delayed-fusion fuse according to the present invention, a thin metallic layer is interposed between the surface of the covering and adhering section made of electrically conductive metal and the surface of the metallic chip made of low fusing point metal. The level of the energy of formation of a solid solution of the thin metallic layer and the low fusing point metallic chip is set to be higher than that relating to the formation of a solid solution of the electrically conductive metal and the low fusing point metal. Therefore, this higher energy of formation acts as a barrier for forming the solid solution in the case of fusing, so that the fusion time of the fuse can be extended.

Further, the energy of formation of a solid solution of the thin metallic layer and the low fusing point metal composing the metallic chip is approximately 7 times as high as the energy of formation of a solid solution of the electrically conductive metal and the low fusing point metal chip. Therefore, it is possible to avoid an overlap of the pre-arcing time-current characteristics of this fuse with the smoking characteristics of the connecting electric wire. Also, the thin metallic layer is a metal-plating layer formed on a surface of the covering and adhering section made of the electrically conductive metal, or a metal-plating layer formed on a surface of the low fusing point metallic chip. Therefore, by the high energy of formation, the diffusion of the metallic chip is facilitated and a stable layer thickness can be realized.

Further, when the thickness of the nickel-plating layer is in a range of 1 to 10 mm, it is possible to avoid an overlap of the pre-arcing time-current characteristics with the smoking characteristics of the connecting electric wire, so that the occurrence of a problem such as a pin-hole can be avoided.

DETAILED DESCRIPTION OF THE PREFERRED EMBODIMENTS

With reference to FIGS. 1 to 6, the present invention will be explained in detail.

Figure 1:
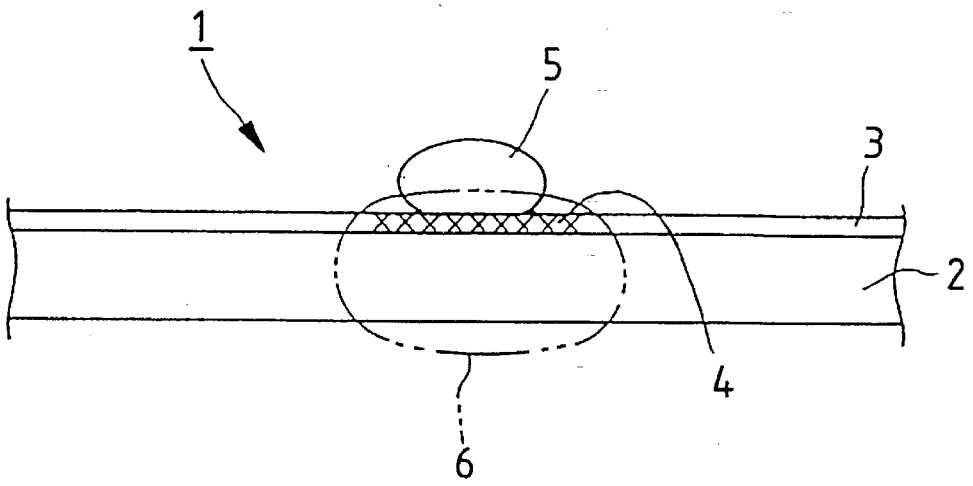
FIG. 1 is a schematic illustration for explaining a first embodiment of the primary section of the delayed-fusion fuse according to the present invention.

FIG. 1 is a schematic illustration for explaining the first embodiment of the delayed-fusion fuse according to the present invention. In the drawing, the delayed-fusion fuse 1 includes a pair of electric connecting sections (not shown) formed on both sides of a fusible section 2 having a narrow fusing portion 6 made of electrically conductive metal. Also, the delayed-fusion fuse 1 includes a metallic chip 5 made of low fusing point metal for absorbing heat generated in the fusible section 2, and a covering and adhering section 4 for holding the metallic chip 5 on the fusible section 2.

A thin metallic layer 3 forms a solid solution with the low fusing point metal, wherein the solid solution requires an energy of formation which is higher than that of the formation of a solid solution made of the electrically conductive metal and the low fusing point metal. This thin metallic layer 3 is interposed between a surface of the covering and adhering section 4 and a surface of the low fusing point metallic chip 5. Specifically, the thin metallic layer 3 is formed on a surface of the fusible section 2. In this example, the thin metallic layer 3 is a plating-layer formed on the surface of the fusible section 2. The process to be adopted here is not limited to plating, but various processes such as vapor deposition, impregnation, and coating can be applied.

Figure 2:
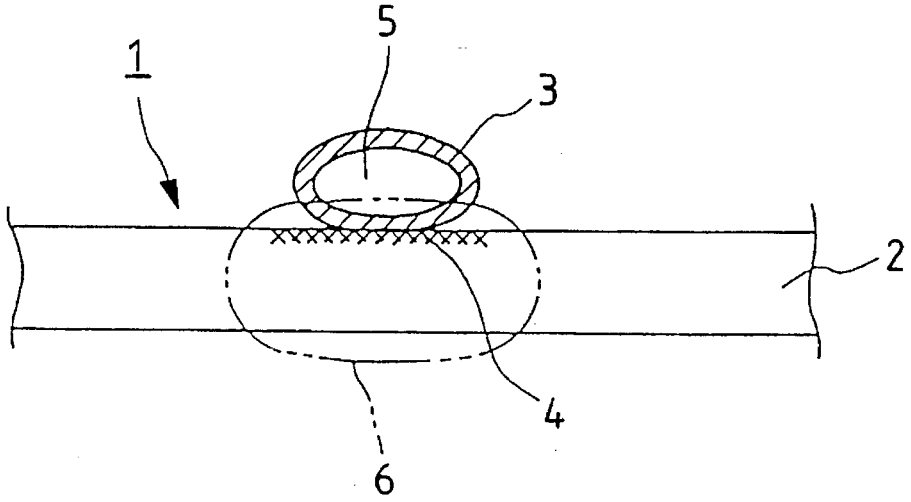
FIG. 2 is a schematic illustration for explaining a primary section of a second embodiment of the delayed-fusion fuse according to the present invention.

FIG. 2 is a schematic illustration for explaining the second example of the delayed-fusion fuse according to the present invention. In the drawing, the delayed-fusion fuse 1 includes a pair of electric connecting sections (not shown) formed on both sides of a fusible section 2 having a narrow fusing portion 6 made of electrically conductive metal. Also, the delayed-fusion fuse 1 includes a covering and adhering section 4 for holding the low fusing point metallic chip 5 formed on the fusible section 2, wherein the low fusing point metallic chip 5 is provided for absorbing heat generated in the fusible section 2.

A thin metallic layer 3 is formed on a surface of the low fusing point metallic chip 5. The metallic material composing the thin metallic layer 3 is selected so that the energy of formation of a solid solution of the thin metallic layer 3 and the low fusing point metallic chip 5 can be higher than the energy of formation of a solid solution of the electrically conductive metal from the fusible section 2 and the low fusing point metal from the metallic chip 5. In this example, the thin metallic layer 3 is a plating layer formed on a surface of the low fusing point metallic chip 5. The process to be adopted here is not limited to plating, but various processes such as vapor deposition, impregnation, and coating can be applied.

Figure 7:
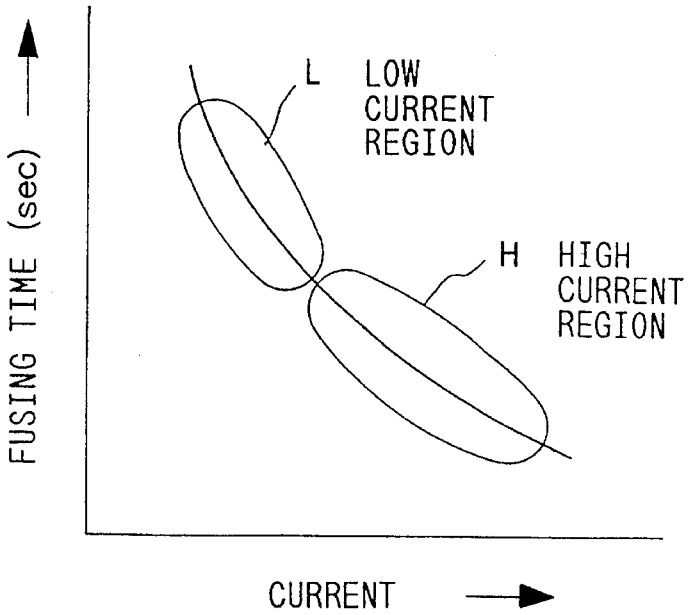
FIG. 7 is a schematic illustration for explaining the operational current region of a fuse.
Figure 8:
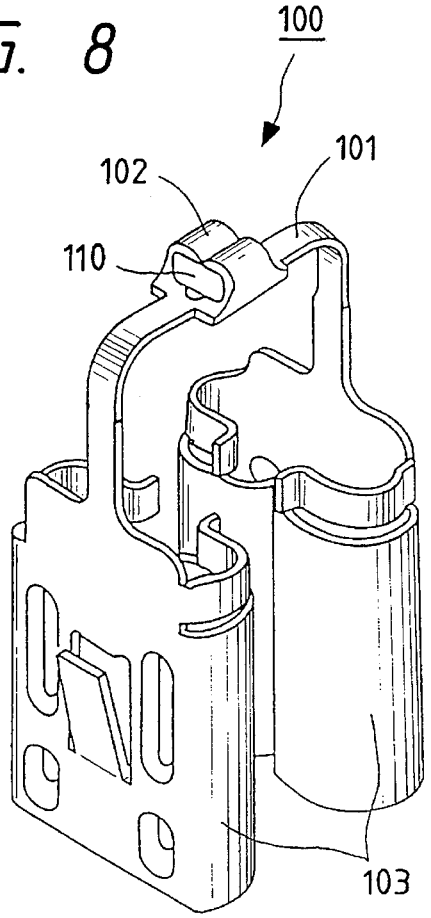
FIG. 8 is a perspective view showing a conventional delayed-fusion fuse.
Figure 9A:
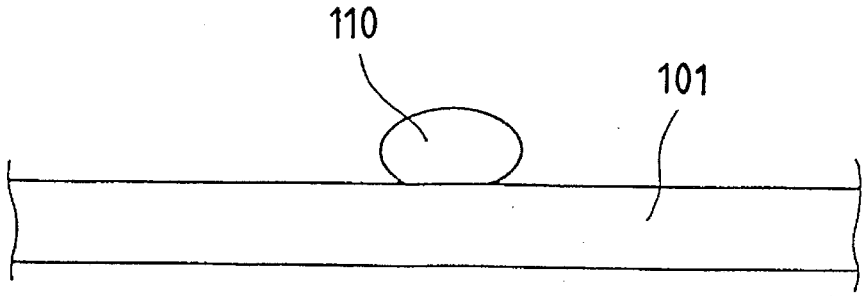
FIGS. 9 (*a*) to (*c*) are schematic illustration for explaining the process of formation of a solid solution of the conventional delayed-fusion fuse.
Figure 9B:
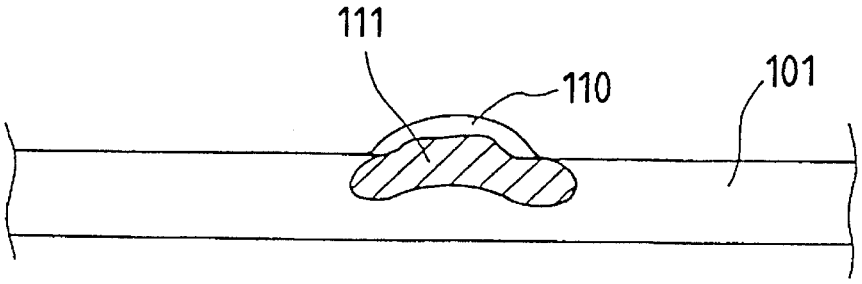
Figure 9C:
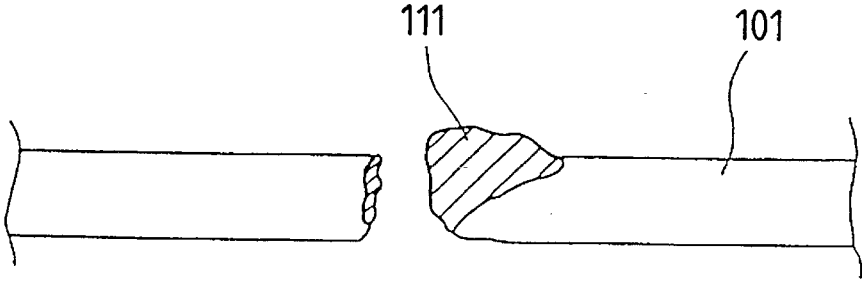

With reference to FIG. 1, the operation of the delayed-fusion fuse of the above construction will be explained below. When a current in the low current region described in FIG. 7 flows from a terminal (not shown) provided on both ends of the fusible section 2 over a long period of time, the temperature of the fusing section 6 is raised by Joule heat. This heat is transmitted to the low fusing point metal chip 5, so that the low fusing point metal chip 5 is heated. Since the low fusing point metal chip 5 is made of low fusing point metal, it fuses earlier than the fusible section 2. As a result, unless the thin metallic layer 3 exists between the low fusing point metallic chip 5 and the fusible section 2, the low fusing point metallic chip 5 easily diffuses into the fusible section 2, and a solid solution can be formed. The fusing point of this solid solution is lower than that of the electrically conductive metal composing the fusible section 2. Therefore, the fusing time would be reduced and the durability of the fuse would be lessened.

However, in the present invention, the thin metallic layer 3 is provided on the fusible section 2 in the form of a plating layer, and the thin metallic layer 3 is interposed between the low fusing point metallic chip 5 and the fusible section 2. At this time, the fusing point of the thin metallic layer 3 is between the fusing point of the electrically conductive metal composing the fusible section 2 and the melting point of the low fusing point metallic chip 5.

For example, in the case where a copper alloy (the fusing point of which is 1050° C.) is used for the electrically conductive metal of the fusible section 2 and tin (the fusing point is 230° C.) is used for the low fusing point metallic chip 5, nickel (the fusing point is 950° C.) can be selected for the thin metallic layer 3.

Metallic material composing the thin metallic layer 3 is selected so that the energy of formation of a solid solution from the thin metallic layer 3 and the low fusing point metallic chip 5 can be higher than the energy of formation of a solid solution from the electrically conductive metal composing the fusible section 2 and the low fusing point metal composing the metallic chip 5.

For example, the energy of formation of a solid solution of tin from the low fusing point metallic chip 5 and copper alloy from the fusible section 2 is 188 KJ/mol. However, the energy of formation of a solid solution of tin and nickel from the thin metallic layer 3 is 274 KJ/mol. Consequently, the level of energy required for the formation of a solid solution of tin and nickel is higher than that required for the formation of a solid solution of tin and copper alloy.

Accordingly, when the thin metallic layer 3 made of nickel is formed between the low fusing point metallic chip 5 made of tin and the fusible section 2 made of copper alloy, the tin does not directly contact with the copper alloy, but it contacts with nickel. Consequently, as described above, in order to form a solid solution of tin and nickel, a higher energy of formation is required, so that it is not easy to form the solid solution of tin. As a result, the fusing time of the fuse is extended.

Figure 3:
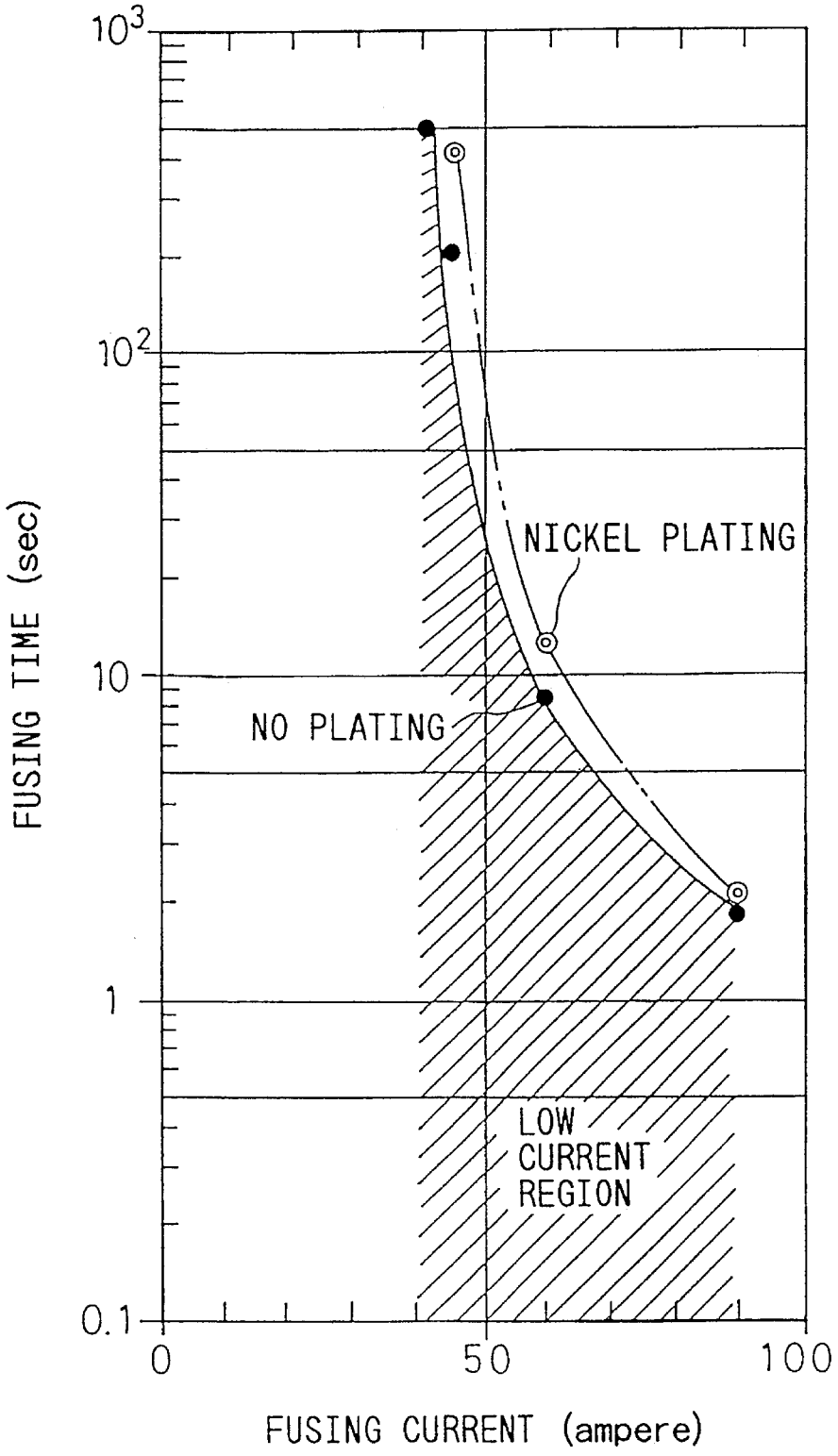
FIG. 3 is a pre-arcing time-current characteristic diagram of the delayed-fusion fuse subjected to nickel plating.

FIG. 3 is a fusion characteristic diagram of the delayed-fusion fuse according to the present invention in which the thin metallic layer 3 is formed of a nickel-plating layer, the thickness of which is 5 μm. In the low current region of which the fusing current is 40 to 90 A, the fusing time of the fuse subjected to nickel-plating of 5 μm thickness is clearly extended longer than that of the fuse having no plating layer. It can be clearly recognized that the effect of the construction provided is based on the difference between the levels of energy of formation.

Figure 4:
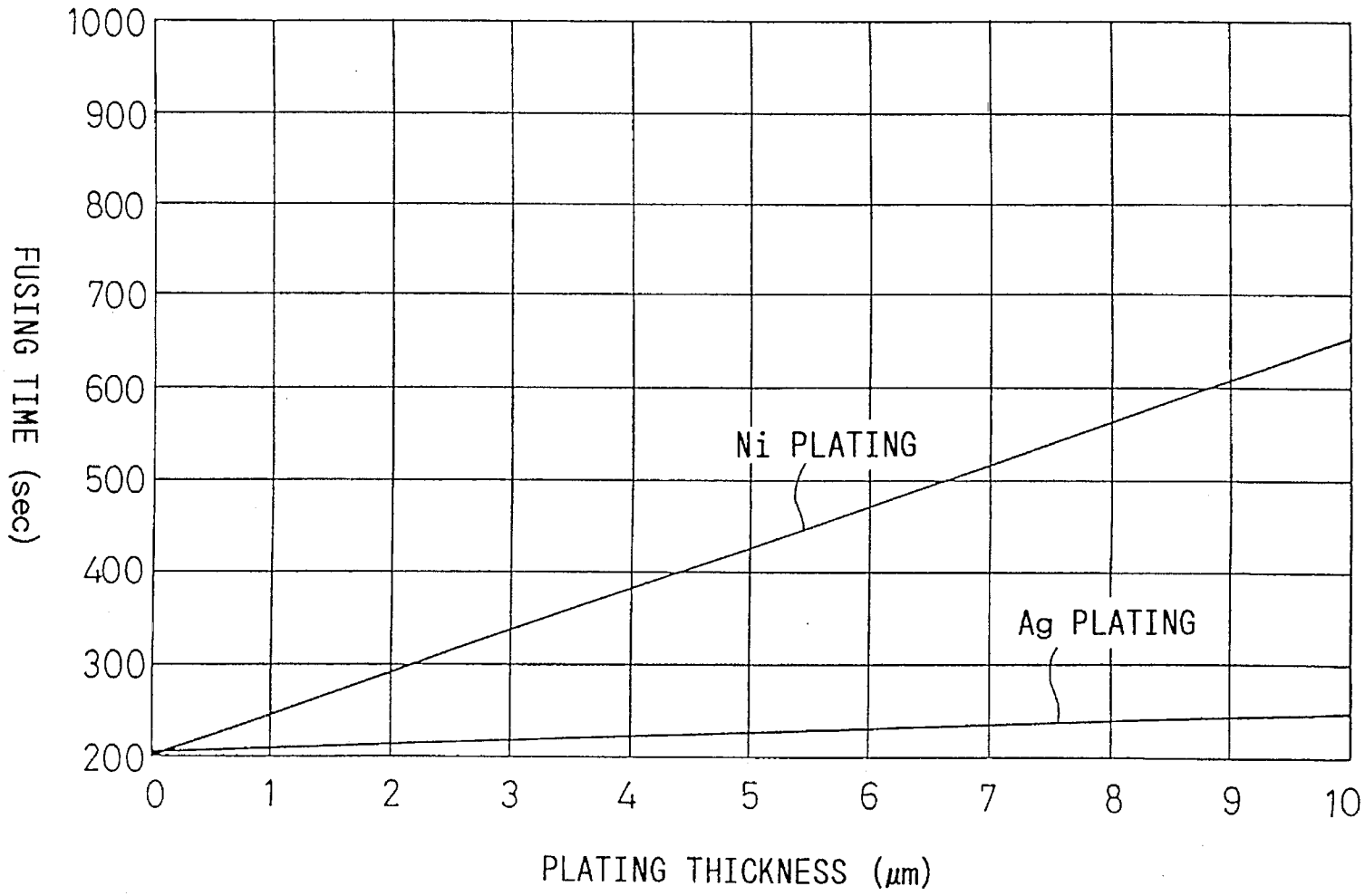
FIG. 4 is a characteristic diagram showing a relation between the plating thickness and the fusing time.

FIG. 4 is a characteristic diagram showing a relation between the thickness of plating and the fusing time of the delayed-fusion fuse of this example, wherein the characteristics in the case of nickel plating and the characteristics in the case of silver plating are shown here. According to this diagram, in the case where plating is not conducted (i.e., the thickness of plating is 0 μm), the fusing time is 200 seconds, however, for example, in the case where a plating layer of 10 μm thickness is formed on the fuse, the fusing time is approximately 650 seconds, so that the fusing time can be extended not less than 3 times as long as that of the delayed-fusion fuse having no plating layer. In the case where silver-plating is adopted, a change in the fusion time is small with respect to the thickness of plating, so that a thicker plating layer than the nickel-plating layer is required.

Figure 6:
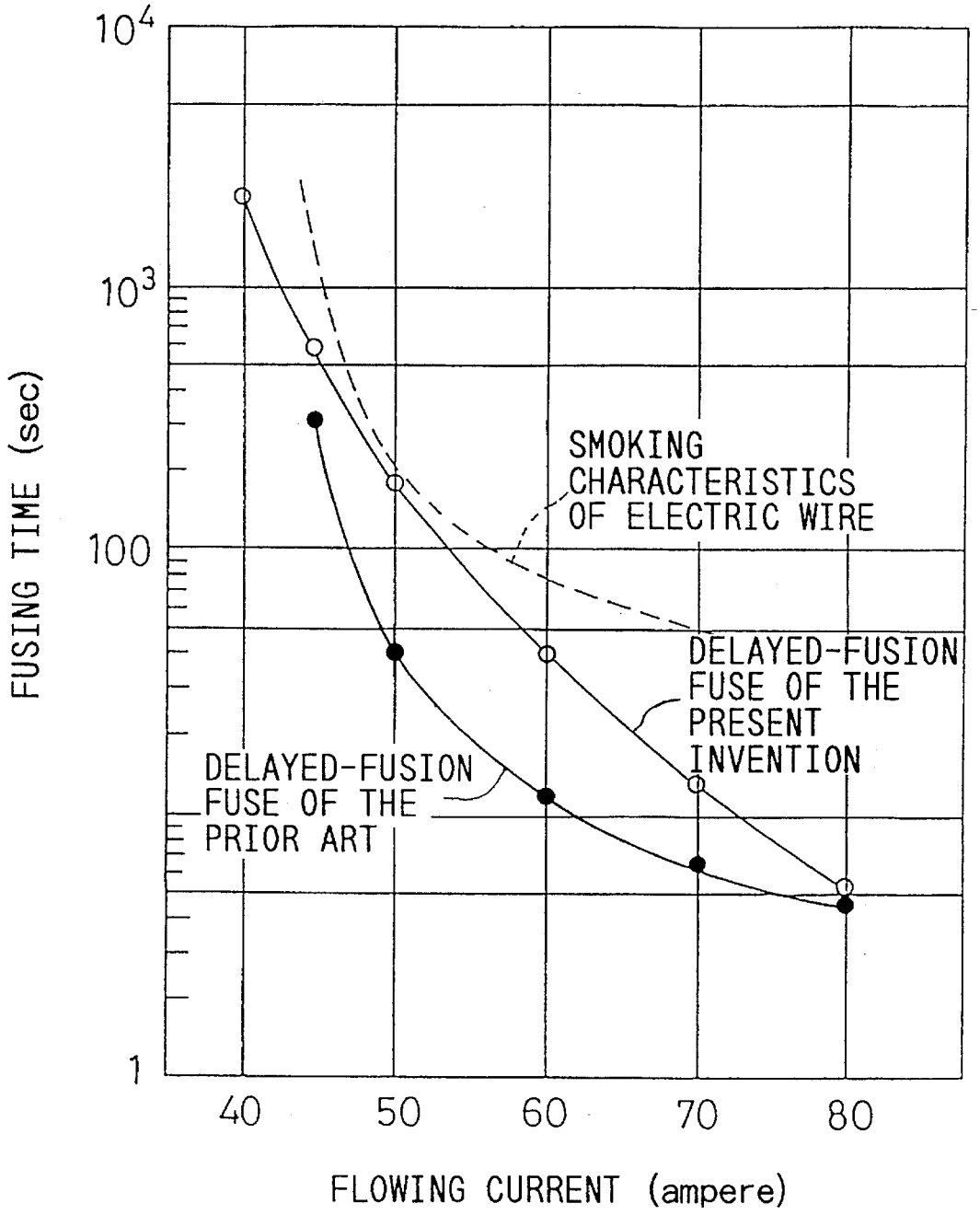
FIG. 6 is an initial pre-arcing time-current characteristic diagram of the delayed-fusion fuse of the present invention and that of the prior art.

The most appropriate plating thickness is determined in accordance with the smoking characteristics of the electric wire shown in FIG. 6 and the cost necessary for providing the plating layer. That is, when the thickness of a plating layer is unnecessarily increased, not only the manufacturing cost is increased but also the fusing time is extended exceedingly. As a result, even when the covering material of the connecting electric wire is overheated, scorched, and smoked, the fuse is not fused away and the opposite effect is brought about. Therefore, it is necessary that the plating layer thickness is set in a range in which the fusing characteristic curve on the graph does not cross with the smoking characteristic curve of the electric wire, or the fusing characteristic curve does not overlap with the smoking characteristic curve of the electric wire. In the case of nickel-plating, it is preferable that the thickness is determined so that it does not exceed 10 μm. On the other hand, when the plating layer thickness is not more than 1 μm, a large number of pin-holes are disadvantageously caused, and it is difficult to bring about the designed effect.

From the viewpoint described above, a preferable range of the nickel-plating thickness is not less than 1 μm and not more than 10 μm. In this connection, in order to form the plating layer, not only nickel but also silver, gold and platinum may be used according to circumstances. However, as described above, nickel is commonly used from the viewpoint of the pre-arcing time-current characteristics and manufacturing cost.

Figure 5:
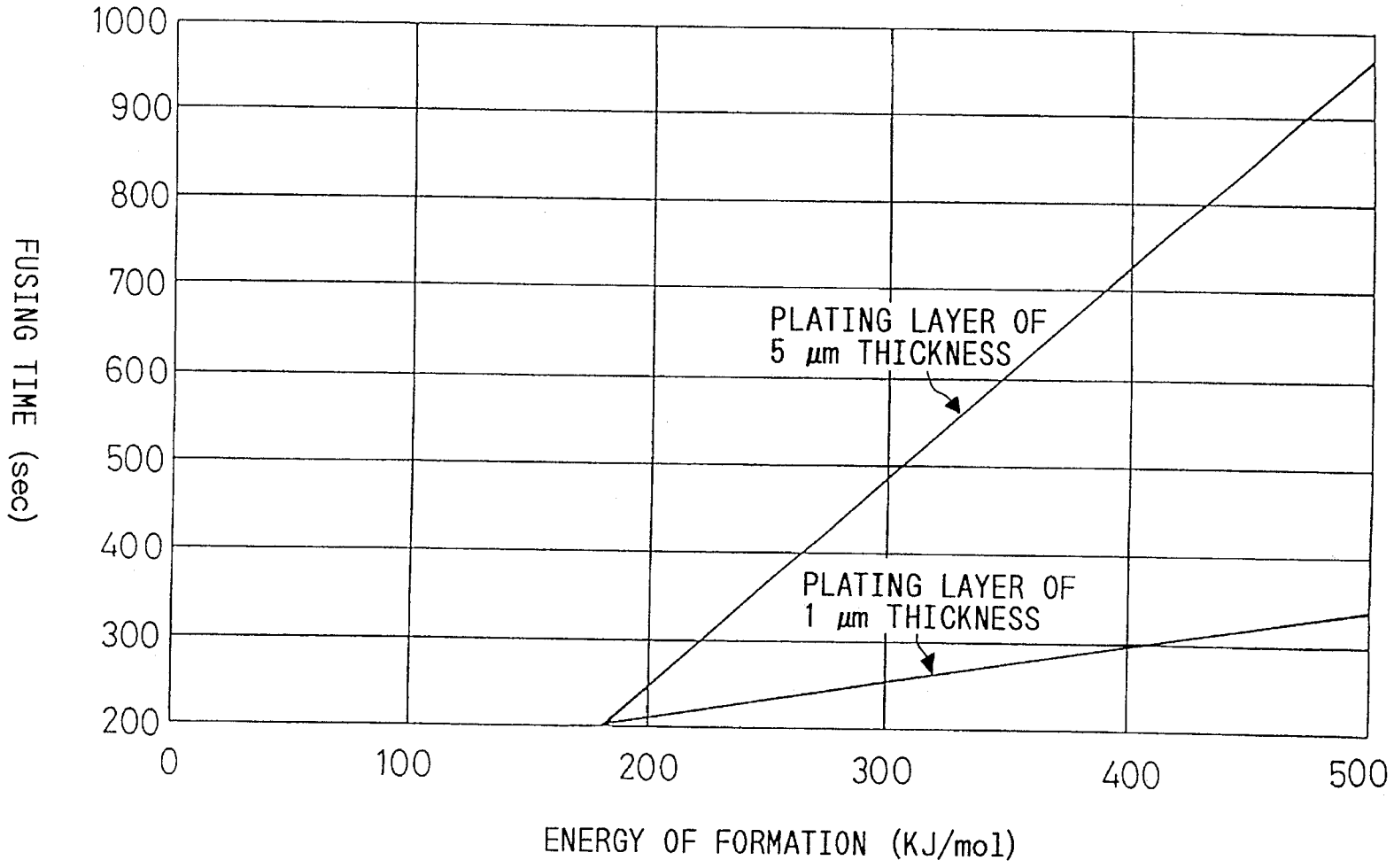
FIG. 5 is a characteristic diagram showing a relation between the energy of formation and the fusing time.

Next, FIG. 5 is a characteristic diagram showing a relation between the energy of formation of the delayed-fusion fuse according to the present invention and the fusing time. In the drawing, the parameter is the thickness of the nickel-plating layer, and a difference of the fusing time is expressed in two cases, one is a case in which the thickness is 1 μm and the other is a case in which the thickness is 5 μm. According to the Metallic Data Book (published by the Japan Metallurgical Society), for example, in order to form a solid solution of copper and tin, an energy of formation of 188 KJ/mol is required, and the fusion time is about 200 seconds.

However, for example, in order to form a solid solution of nickel and tin, an energy of formation of 274 KJ/mol is required, and the fusing time of the nickel-plating layer of 1 mm thickness is about 250 seconds, so that the fusing time can be extended approximately by 20% compared with the aforementioned fusing time of the solid solution of copper and tin.

Further, when the nickel-plating layer is 5 μm thick, the fusing time of the combination of copper and tin (in which 188 KJ/mol of energy of formation is required) is about 200 seconds as described above. The fusing time of a solid solution of the combination of nickel and tin (which requires 274 KJ/mol of energy of formation) is about 430 seconds. Therefore, the fusing time can be extended by not less than 110% of the fusing time of the solid solution of copper and tin.

The most appropriate combination of metals should be selected from the combinations of metals, the energy of formation of which is high when a solid solution is formed, while consideration is given to the processing property and the manufacturing cost. However, from the viewpoint of durability, it is effective that the selection is made in the following manner. The energy of formation of a combination of the electrically conductive metal composing the fusible section and the low fusing point metallic chip is used as a basis. The energy of formation of a combination of the low fusing point metallic chip and the plating layer of the thin metallic layer formed on the fusible section is in a range 7 times as high as the above basis. Selection should be made in the above range.

As described above, when the energy of formation of a solid solution is high in the combination of metals, it is effective as a barrier of energy, and the fusing time is extended. In the case where the combination of metals is the same, plating layer thickness and fusing time are proportional.

FIG. 6 is an initial fusing characteristic diagram of the delayed-fusion fuse of the present invention and that of the conventional fuse. In the drawing, a curve connecting white circles expresses the pre-arcing time-current characteristics of the delayed-fusion fuse having a nickel-plating layer of the present invention, and a curve connecting black circles expresses the pre-arcing time-current characteristics of the delayed-fusion fuse of the conventional fuse having no plating layer. From these two curves, it can be seen that the fusing time in the low current region is increased and improved in the delayed-fusion fuse of the present invention. For example, when a current of 60 A flows in the fuse, the fusing time of the delayed-fusion fuse of the conventional fuse having no plating layer is about 12 seconds, however, the fusing time of the delayed-fusion fuse of the present invention is about 45 seconds. Therefore, the fusing time is extended by approximately 4 times.

As described above, in the delayed-fusion fuse of the present invention, because of the action of high energy of formation of the thin metallic layer of nickel plating, the low fusing point metallic chip made of tin can be effectively prevented from diffusing into the fusible section made of copper. Therefore, the fusing time can be extended, and even when a current exceeding the steady-state current such as a motor lock current repeatedly flows in the fuse, it is difficult for the fusing section to fuse away, so that the durability of the fuse can be enhanced.

As the durability of the delayed-fusion fuse of the present invention is enhanced, it can be used as substitute for a circuit breaker. Further, the delayed-fusion fuse of the present invention endures even when a lock current for driving an electric motor flows in the fuse not less than 50000 times. Further, it is possible to design the pre-arcing time-current characteristics of the fuse so that the characteristics can not overlap with the smoking characteristics of the connecting electric wire. Accordingly, it can be realized that the fuse of this example effectively functions as a circuit protection mechanism.

As explained above, according to the delayed-fusion fuse of the present invention, the thin metallic layer is selected so that the energy of formation of a solid solution of the thin metallic layer and the low fusing point metal can be higher than the energy of formation of a solid solution of the electrically conductive metal and the low fusing point metal. In this way, the thin metallic layer is interposed between a surface of the covering and adhering section made of the electrically conductive metal and a surface of the metallic chip made of the low fusing point metal. Accordingly, the thin metallic layer functions as a barrier of energy, and the low fusing point metal can be prevented from diffusing into the electrically conductive metal in the process of fusing to form a solid solution, and the fusing time can be extended.

As a result, even when a current exceeding the steady-state current such as a motor lock current flows in the fuse, the predetermined durability can be ensured, and the stable pre-arcing time-current characteristics can be provided.

What is claimed is:

1. A delayed-fusion fuse comprising:

a fusible section having a narrow fusion portion made of electrically conductive metal;

a pair of electric connecting sections provided on both sides of said fusible section;

a metallic chip made of low fusing point metal for absorbing heat generated in said fusible section;

a covering and adhering section for holding said metallic chip; and a thin metallic layer, disposed between a surface of said covering and adhering section made of said electrically conductive metal and a surface of said metallic chip, for increasing the energy of formation of a solid solution, said thin metallic layer including a nickel-plating layer having a thickness between 1 and 10 μm, wherein the energy of formation of a solid solution of said nickel-plating layer and said low fusing point metal of which said metallic chip is made is higher than the energy of formation of a solid solution of said low fusing point metal and said electrically conductive metal of which said fusible section is made.

2. The delayed-fusion fuse according to claim 1, wherein the energy of formation of said solid solution of said nickel-plating layer and said low fusing point metal from said metallic chip is 7 times as high as the energy of formation of said low fusing point metal and said solid solution of said electrically conductive metal of which said fusible section is made.

3. The delayed-fusion fuse according to claim 1, wherein said nickel-plating layer is a metal-plating layer formed on a surface of said covering and adhering section.

4. The delayed-fusion fuse according to claim 2, wherein said nickel-plating layer is a metal-plating layer formed on a surface of said covering and adhering section.

5. The delayed-fusion fuse according to claim 2, wherein said nickel-plating layer is a metal-plating layer formed on a surface of said metallic chip.

* * * * *